United States Patent [19]

Zielke

[11] 4,136,056

[45] Jan. 23, 1979

[54] REGENERATION OF ZINC CHLORIDE HYDROCRACKING CATALYST

[75] Inventor: Clyde W. Zielke, Bethel Park, Pa.

[73] Assignees: Continental Oil Company, Stamford, Conn.; The United States of America as represented by the United States Department of Energy, Washington, D.C.

[21] Appl. No.: 823,764

[22] Filed: Aug. 11, 1977

[51] Int. Cl.[2] ..... B01J 27/32

[52] U.S. Cl. ..... 252/415; 208/10; 208/108; 252/416; 423/107; 423/491

[58] Field of Search ..... 252/415, 416, 419; 208/10, 108; 423/107, 331, 491

[56] References Cited

U.S. PATENT DOCUMENTS

| | | | |
|---|---|---|---|
| 3,355,376 | 11/1967 | Gorin et al. | 208/10 |
| 3,371,049 | 2/1968 | Gorin et al. | 208/10 |
| 3,594,329 | 7/1971 | Gorin et al. | 252/417 |
| 3,625,861 | 12/1971 | Gorin | 252/416 |
| 3,629,159 | 12/1971 | Gorin et al. | 208/10 |
| 4,081,400 | 3/1978 | Gorin | 252/415 |

FOREIGN PATENT DOCUMENTS

| | | | |
|---|---|---|---|
| 31550 | 4/1885 | Fed. Rep. of Germany | 423/491 |
| 11031 of | 1916 | United Kingdom | 423/107 |
| 1095851 | 12/1967 | United Kingdom | 208/10 |

*Primary Examiner*—P. E. Konopka

*Attorney, Agent, or Firm*—F. Lindsey Scott; William A. Mikesell, Jr.; D. Leigh Fowler, Jr.

[57] ABSTRACT

Improved rate of recovery of zinc values from the solids which are carried over by the effluent vapors from the oxidative vapor phase regeneration of spent zinc chloride catalyst is achieved by treatment of the solids with both hydrogen chloride and calcium chloride to selectively and rapidly recover the zinc values as zinc chloride.

1 Claim, 1 Drawing Figure

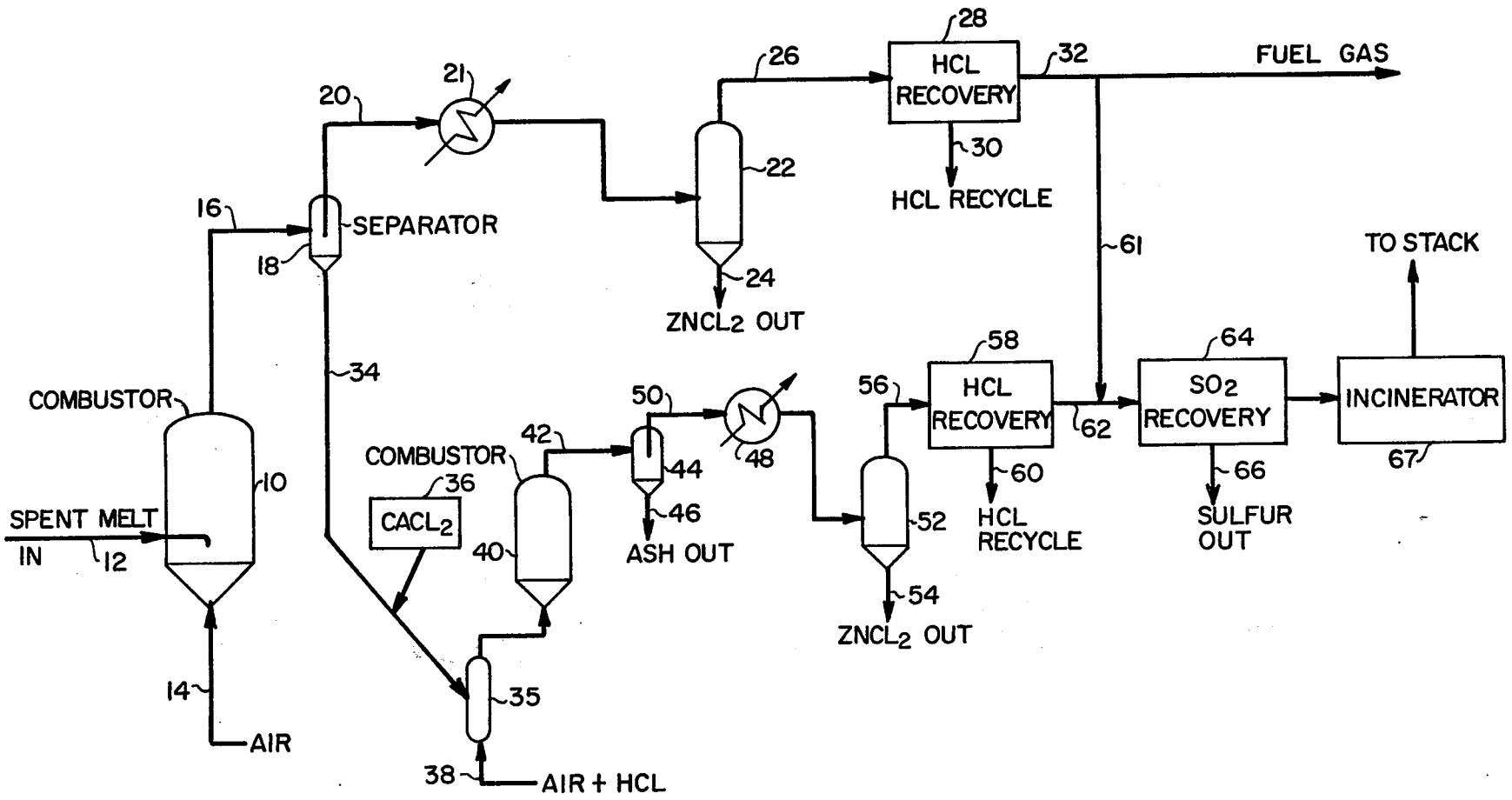
FUEL GAS
TO STACK
INCINERATOR
67
64
SO2 RECOVERY
66
SULFUR OUT
61
62
32
28
HCL RECOVERY
30
HCL RECYCLE
58
HCL RECOVERY
60
HCL RECYCLE
56
52
54
ZNCL2 OUT
26
22
24
ZNCL2 OUT
48
50
44
46
ASH OUT
42
40
35
AIR + HCL
38
21
SEPARATOR
COMBUSTOR
36
CACL2
20
18
34
16
10
AIR
14
COMBUSTOR
SPENT MELT IN
12

REGENERATION OF ZINC CHLORIDE HYDROCRACKING CATALYST

This invention was made in the course of or under a contract with the Energy Research and Development Administration.

RELATED APPLICATION

This application contains subject matter which is related to that of pending application Ser. No. 764,616, filed Feb. 1, 1977 by E. Gorin, entitled "Regeneration of Zinc Halide Catalyst Used in the Hydrocracking of Polynuclear Hydrocarbons," and assigned to the assignee of the present invention.

BACKGROUND OF THE INVENTION

This invention relates to the regeneration of molten zinc chloride catalyst used in the hydrocracking of coaly solids and products derived from coaly solids such as coal extracts or coal liquefaction products.

A process for utilizing molten zinc chloride in such catalytic hydrocracking is described in British Pat. No. 1,095,851. As set forth in that patent, it was found that polynuclear hydrocarbons, even those which are non-distillable, may be readily converted in the presence of a large quantity of molten zinc chloride to low boiling liquids suitable for fuels, such as gasoline. The amount of zinc chloride which serves as catalyst is at least 15 weight percent of the inventory of hydrocarbonaceous material in the hydrocracking zone. To this amount of zinc chloride is added, in the case of nitrogen- and sulfur-containing feedstock, sufficient zinc chloride to remove reactive nitrogen and sulfur compounds in the feedstock, in accordance with the following equations:

(1) $ZnCl_2 + H_2S = ZnS + HCl$ (2) $ZnCl_2 + NH_3 = ZnCl_2 \cdot NH_3$ (3) $ZnCl_2 \cdot NH_3 + HCl = ZnCl_2 \cdot NH_4Cl$ In the case of a feedstock consisting of coal extract containing, for example, 1.5 percent N and 2 percent S, the amount of zinc chloride required to react stoichiometrically with the nitrogen and sulfur compounds would be 23 percent by weight of the feedstock.

The spent zinc chloride melt from the hydrocracking zone contains (in addition to zinc chloride) zinc sulfide (see Equation 1), $ZnCl_2 \cdot NH_3$ (see Equation 2), organic residue, and ash, as well as zinc oxide if the latter were used as an HCl acceptor. U.S. Pat. No. 3,355,376 describes two methods of regenerating the spent zinc chloride melt, both involving oxidation of the impurities, one in liquid phase and one in vapor phase. The reactions occurring in such oxidative regenerative processes are set forth in the following equations:

(4) $NH_3 + \frac{3}{4} O_2 = \frac{1}{2} N_2 + 3/2\ H_2O$ (5) $ZnO + 2\ HCl = ZnCl_2 + H_2O$ (6) $ZnS + 3/2\ O_2 = ZnO + SO_2$ (7) $C + O_2 = CO_2$ (8) $C + \frac{1}{2} O_2 = CO$ In vapor phase oxidation, air is used to effect combustion of the organic residue, to thereby establish and maintain a temperature in the regenerator at which zinc chloride is vaporized. The effluent zinc chloride vapors carry with them finely divided solids containing zinc values in the form of water-soluble and water-insoluble compounds, for example, "free" zinc oxide and zinc oxide chemically combined with acidic oxides such as silica which are present in the feedstocks to the hydrocracking zone.

In the above-cited related application, Ser. No. 764,616, a process is described for recovery of zinc values which are entrained in the effluent zinc chloride vapors from a vapor phase oxidative regenerator. The regenerative process therein described comprises four steps. In the first step, the spent zinc chloride melt from the hydrocracking zone is subjected to vapor phase oxidative treatment by combustion of the carbon and sulfur compounds, as well as any ammonia that may be present. In this step, the temperature is maintained at least high enough to assure vaporization of the zinc chloride. The effluent vapors contain finely divided solids composed of zinc oxide and zinc oxide complexes derived from the feedstock to the hydrocracking zone, some of which we now known to be water-soluble, and some water-insoluble, e.g., $ZnO \cdot SiO_2$. There generally is some residual organic residue in the entrained solids. The second step of the process consists of the separation of the zinc chloride vapors from the solids by any conventional means, generally a cyclone. The third step consists of the treatment of the separated solids with a hydrogen chloride-containing gas under conditions favoring the reaction of zinc oxide and hydrogen chloride at a temperature sufficiently high to form zinc chloride in the vapor state. In the fourth step, vaporous zinc chloride is separated from the ash and condensed to the molten state for recycle to the hydrocracking zone.

The primary object of the present invention is to provide an improvement in the process for regenerating spent zinc chloride whereby the rate of recovery of zinc values from the solids entrained in the effluent zinc chloride vapors from the regenerator is increased.

The following patents were considered in the preparation of this application: Br. Patent No. 1,095,851, U.S. Pat. Nos. 3,355,376, 3,371,049, 3,594,329, 3,625,861, 3,629,159.

SUMMARY OF THE INVENTION

The regeneration process of my invention is an improvement in the above-described four-step process of the above-cited application, Ser. No. 764,616. I have observed that the rate of recovery of water-insoluble zinc values from the separated solids from the second step of said process is relatively slow. My invention consists in treating said separated solids with both hydrogen chloride and calcium chloride, whereby the rate of recovery of the water-insoluble zinc values is improved. This behavior may be explained by the following equation:

$$ZnO \cdot SiO_2 + CaCl_2 = CaO \cdot SiO_2 + ZnCl_2 \downarrow$$

DESCRIPTION OF THE DRAWING

The drawing is a schematic flowsheet of the preferred embodiment of the improved regeneration process of the present invention.

PREFERRED EMBODIMENT

Referring to the drawing, spent zinc chloride melt is fed to a Combustor 10 through a conduit 12. The spent zinc chloride melt resulting from the hydrocracking of coal or coal derived products contains, in addition to zinc chloride, carbonaceous residue as well as ash, sulfur, and nitrogen components. The carbon, sulfur and nitrogen components in the spent catalyst are oxidized by air fed to the Combustor via a conduit 14. The air preferably contains a low concentration of HCl to aid in preventing hydrolysis of zinc chloride by steam. The combustion conducted in the Combustor may be either with less than or greater than, the stoichiometric amount of air. In the former case, fuel gas will be produced; in the latter case, flue gas. Heat is generated in the Combustor by oxidation of the carbon contained in the spent melt, and is sufficient to maintain the temperature in the Combustor above the vaporization temperature of zinc chloride. The latter, in vapor form, together with steam, non-condensable gases, $N_2$, CO and $CO_2$, unreacted HCl, and entrained solids, is withdrawn from the Combustor 10 through a conduit 16 to a hot Separator 18 which is any cyclone commonly used for the separation of gases and solids at high temperature. In this instance, the temperature of the cyclone is not permitted to drop below the condensation point of zinc chloride.

Zinc chloride and water vapors and non-condensable gases CO, $CO_2$, $N_2$ and HCl are withdrawn from the Separator 18 through a conduit 20 to a condenser 22 for selective condensation after passing through a precooler 21. Zinc chloride condensate in molten form is discharged from the condenser 22 through a conduit 24 for return to the hydrocracking zone (not shown). The non-condensable gases are withdrawn from the condenser through conduit 26 to a suitable HCl recovery zone 28 from which HCl is recovered through conduit 30 for reuse in the process. A gas is withdrawn from the HCl recovery zone through conduit 32 which is a low sulfur fuel gas whenever sub-stoichiometric quantities of air are used in Combustor 10.

A typical analysis of the separated solids from Separator 18 is as follows:

TABLE I

| Analysis of Cyclone Ash (% by weight) | |
|---|---|
| Zn (in the form of water soluble zinc compounds) | 2.94 |
| Zn (in the form of water insoluble zinc compounds) | 4.54 |
| Cl | 4.92 |
| H | 0.08 |
| C | 0.09 |
| S | 0.37 |
| $Na_2O$ | 0.10 |
| $K_2O$ | 0.03 |
| CaO | 11.40 |
| MgO | 4.45 |
| $Fe_2O_3$ | 3.90 |
| $TiO_2$ | 0.94 |
| $SiO_2$ | 42.86 |
| $Al_2O_3$ | 18.41 |
| | 95.03* |

*Other compounds were obviously present that could not be readily determined.

The solids discharged from the hot Separator 18 are conducted by a conduit 34 to a premixer and preheater 35. $CaCl_2$ in finely divided form is introduced into conduit 34 from a hopper 36. The amount is preferably twice the amount needed to react with the water-insoluble zinc compounds, as determined by analysis. The solids are mixed with a stream of HCl-containing gas introduced through a conduit 38. The gas may conveniently be air or combustion gases. The mixture of gases and entrained solids is transferred to a second Combustor 40 where the zinc oxide and zinc oxide complexes are converted to zinc chloride by reaction with HCl and $CaCl_2$. The temperature of the Combustor is maintained above the vaporization temperature of zinc chloride, for example 1700° F, by the oxidation of carbon in the case where oxygen is contained in the HCl-containing gas. The carbon is that contained in the unconsumed organic residue carried over from the first Combustor or is added as required to the second Combustor expressly for that purpose. Such added or supplemental carbon may be in the form of coal.

Zinc chloride vapors, ash and non-condensable gases are withdrawn from the Combustor 40 through a conduit 42 to a hot cyclone Separator 44 where the ash containing added calcium is rejected through a line 46. The vapors and gases pass through a pre-cooler 48 in a conduit 50 to a condenser 52 adapted to selectively condense zinc chloride in molten form. The molten zinc chloride is withdrawn through line 54 for recycle. The non-condensable gas is withdrawn through a conduit 56 to a suitable HCl recovery zone 58 for recovery of HCl through a conduit 60. The HCl-free gas, together with any sulfur-rich gas withdrawn from conduit 32 through a conduit 61, is conducted through a conduit 62 to an $SO_2$-reduction zone 64 for conversion of $SO_2$ in the gas to elemental sulfur. The amount of $SO_2$ in conduit 32 and in conduit 62 is a function of the amount of air used in Combustor 10, the larger the amount of air, the greater the amount of $SO_2$ in conduit 32, and conversely the smaller the amount, the larger the amount in conduit 62. In either case, it is desirable to recover such $SO_2$ as sulfur. The CO and $H_2$ contained in the gas provides a suitable source of reducing agent for $SO_2$ reduction. The sulfur product is recovered through a conduit 66. The remaining gas may be incinerated in an incinerator 67 to remove residual sulfur compounds.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a process for regenerating spent molten zinc chloride catalyst resulting from the hydrocracking of coal or coal derived products and containing, in addition to zinc chloride, water-soluble and water-insoluble zinc values in solid form, carbonaceous residue as well as ash, sulfur, and nitrogen components, which comprises (a) subjecting said spent molten zinc chloride catalyst to vapor phase oxidative treatment by combustion of the carbon and sulfur compounds, as well as any ammonia that may be present, at a temperature at least high enough to assure vaporization of zinc chloride, whereby effluent vapors are produced which contain finely divided solids composed of zinc oxide and zinc oxide complexes derived from the hydrocracking of said coal or coal derived products, some of said zinc oxide complexes being water-soluble, and some water-insoluble, along with some residual organic residue in the entrained solids; (b) separating zinc chloride vapors from the solids in said effluent vapors; (c) treating said separated solids with a hydrogen chloride-containing gas under conditions favoring the reaction of zinc oxide and hydrogen chloride at a temperature sufficiently high to form zinc chloride in the vapor state; and (d) separately recovering said vaporous zinc chloride and condensing it to the molten state for recycle to the hydrocracking of said coal or coal derived products, the improvement which comprises (1) mixing $CaCl_2$ in finely divided form with said separated solids from the above-mentioned step (b) in an amount twice the amount needed to react with said water-insoluble zinc compounds;

(2) mixing said solids from step (1) with a stream of HCL-containing oxygen; and (3) reacting said zinc oxide and zinc oxide complexes with HCL and $CaCl_2$ at a temperature above the vaporization temperature of zinc chloride, to form vaporous zinc chloride which is thereafter recovered and condensed as aforementioned in the preamble.

* * * * *

UNITED STATES PATENT OFFICE

CERTIFICATE OF CORRECTION

PATENT NO. : 4,136,056

DATED : January 23, 1979

INVENTOR(S) : Clyde W. Zielke

It is certified that error appears in the above-identified patent and that said Letters Patent are hereby corrected as shown below:

Col. 2, line 62: In the formula, $ZnO \cdot SiO_2 + CaCl_2 = CaO \cdot SiO_2 + ZnCl_2 \downarrow$ should read -- $ZnO \cdot SiO_2 + CaCl_2 = CaO \cdot SiO_2 + ZnCl_2 \uparrow$ --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*